US008696161B2

(12) United States Patent
Pan et al.

(10) Patent No.: US 8,696,161 B2
(45) Date of Patent: Apr. 15, 2014

(54) HIGH-LUMINANCE UV LED NAIL LAMP STRUCTURE AND LED LIGHT SOURCE MODULE THEREOF

(75) Inventors: Ching-Jen Pan, Zhudong Town (TW); Cheng-Wei Chan, Zhudong Town (TW); Ming-Hung Chen, Zhudong Town (TW)

(73) Assignee: Seoul National University Industry Foundation, Seoul (KR)

( * ) Notice: Subject to any disclaimer, the term of this patent is extended or adjusted under 35 U.S.C. 154(b) by 222 days.

(21) Appl. No.: 13/314,352

(22) Filed: Dec. 8, 2011

(65) Prior Publication Data

US 2013/0109001 A1 May 2, 2013

(30) Foreign Application Priority Data

Nov. 2, 2011 (TW) ..... 100220718 U

(51) Int. Cl.
*F21V 21/00* (2006.01)
*F26B 19/00* (2006.01)

(52) U.S. Cl.
CPC ..... *F26B 19/00* (2013.01)
USPC ..... 362/249.02; 362/311.02; 362/311.04; 257/98; 257/100; 434/278

(58) Field of Classification Search
CPC ..... F26B 17/00
USPC ..... 362/97.1, 97.2, 7, 3, 311.1; 257/98–100; 434/278
See application file for complete search history.

(56) References Cited

U.S. PATENT DOCUMENTS

| | | | | |
|---|---|---|---|---|
| 7,311,431 | B2 * | 12/2007 | Chew et al. | 362/613 |
| 7,677,899 | B2 * | 3/2010 | Low | 439/56 |
| D692,617 | S * | 10/2013 | Haile | D28/58 |
| 2004/0116640 | A1 * | 6/2004 | Miyoshi | 528/12 |
| 2007/0012931 | A1 * | 1/2007 | Lee et al. | 257/89 |
| 2009/0068856 | A1 * | 3/2009 | Low | 439/56 |
| 2012/0187311 | A1 * | 7/2012 | Vu et al. | 250/492.1 |

* cited by examiner

*Primary Examiner* — Ali Alavi
(74) *Attorney, Agent, or Firm* — Morris, Manning & Martin, LLP; Juan Carlos A. Marquez

(57) ABSTRACT

A high-luminance ultraviolet (UV) light-emitting diode (LED) nail lamp structure and an LED light source module thereof are provided. The LED nail lamp structure includes a housing and an LED light source module. The LED light source module is provided in the housing and has a plurality of UV LEDs, wherein each UV LED has an LED chip disposed in a concave lamp cup. The LED nail lamp structure features high luminance and good lighting effect.

7 Claims, 6 Drawing Sheets

HIGH-LUMINANCE UV LED NAIL LAMP STRUCTURE AND LED LIGHT SOURCE MODULE THEREOF

BACKGROUND OF THE INVENTION

1. Technical Field

The present invention relates to a high-luminance ultraviolet (UV) light-emitting diode (LED) nail lamp structure and an LED light source module thereof. More particularly, the present invention relates to a high-luminance UV LED nail lamp structure for use in light therapy, and an LED light source module thereof.

2. Description of Related Art

With the continuous advancement of LED technology, and thanks to their increasingly lower costs and energy saving features, LEDs have been extensively used in various lighting apparatuses. For example, LED lighting can be used to cure particular liquids, thereby forming a protective layer on industrial products. In the cosmetic industry, LED lighting can be used to cure UV curable gels and turn them into decorative or protective nail coatings. As a matter of fact, the conventional UV lamps in the foregoing applications have been gradually replaced by UV LEDs.

The conventional UV lamps have the following disadvantages. First of all, they emit UV radiation in the ultraviolet A (UVA), ultraviolet B (UVB), and ultraviolet C (UVC) bands, and long-term exposure to such UV radiation is carcinogenic. Secondly, as UV light tubes contain mercury, waste or damaged UV light tubes are harmful to human health and cause serious pollution. Last but not least, UV light tubes are bulky and therefore unsuitable for being carried around. UV LEDs are a perfect solution to the above problems not only because their light is closer to the less harmful visible light band, but also because of their easier post-consumer treatment and higher portability. Hence, UV LEDs have been viewed in the nail decoration industry as a safer UV light source that can be carried around more conveniently.

During the nail decoration process, the time required for curing an UV curable gel is related to the luminance of the UV LEDs in use. If the curing time is long, the performance of nail art will be hindered, and customer waiting time will be increased, thereby raising the costs of working time. In order to effectively shorten the curing time of UV curable gels and thereby reduce the associated costs, an LED nail lamp structure capable of providing high-luminance UV lighting is needed.

BRIEF SUMMARY OF THE INVENTION

The present invention discloses a high-luminance UV LED nail lamp structure which includes a housing and an LED light source module. The prevent invention aims to improve the luminance and lighting effect of the conventional LED nail lamp structures.

The present invention provides a high-luminance ultraviolet (UV) light-emitting diode (LED) nail lamp structure, comprising: a housing formed as a hollow housing and having an opening; and an LED light source module configured as an UV light source and provided on an upper side in the housing so as to project light downward, the LED light source module comprising: a circuit board; and a plurality of UV LEDs fixedly provided on and electrically connected to the circuit board, each said UV LED comprising: a supporting frame comprising a concave lamp cup and at least two electrodes; an LED chip provided in and connected to the concave lamp cup and electrically connected to the electrodes; a silicone filled in the concave lamp cup and covering the LED chip; and a lens connected to and covering the supporting frame.

The present invention also provides a light-emitting diode (LED) light source module, configured as a high-luminance ultraviolet (UV) light source and applicable to an LED nail lamp structure, the LED light source module comprising: a circuit board; and a plurality of UV LEDs fixedly provided on and electrically connected to the circuit board, each said UV LED comprising: a supporting frame comprising a concave lamp cup and at least two electrodes; an LED chip provided in and connected to the concave lamp cup and electrically connected to the electrodes; a silicone filled in the concave lamp cup and covering the LED chip; and a lens connected to and covering the supporting frame.

Implementation of the present invention at least involves the following inventive steps:

1. The LED nail lamp structure is configured for better lighting effect.

2. The LED light source module is configured for higher luminance.

The detailed features and advantages of the present invention will be described in detail with reference to the preferred embodiment so as to enable persons skilled in the art to gain insight into the technical disclosure of the present invention, implement the present invention accordingly, and readily understand the objectives and advantages of the present invention by perusal of the contents disclosed in the specification, the claims, and the accompanying drawings.

DETAILED DESCRIPTION OF THE INVENTION

Figure 1:
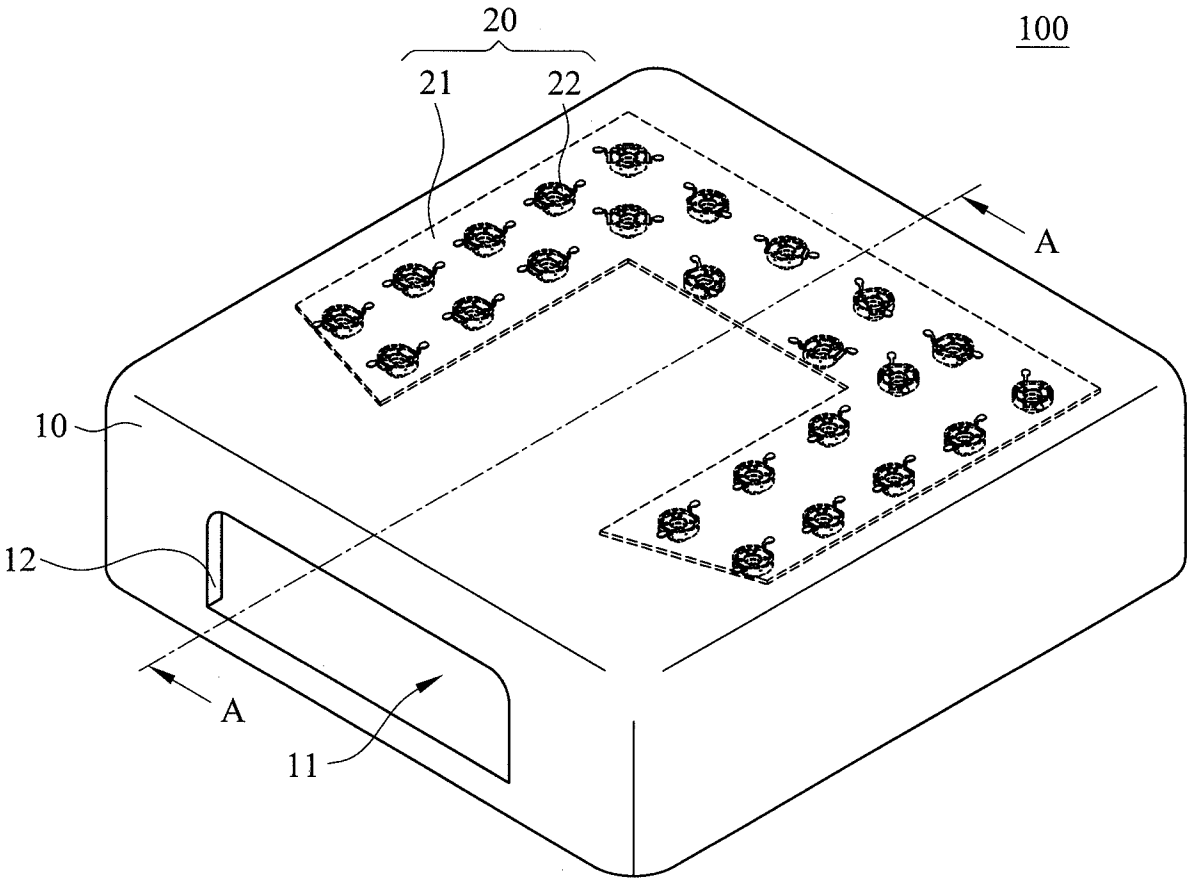
FIG. 1 is an assembled perspective view of a high-luminance UV LED nail lamp structure according to an embodiment of the present invention.

Referring to FIG. 1, a high-luminance UV LED nail lamp structure 100 according to an embodiment of the present invention includes a housing 10 and an LED light source module 20.

Figure 2:
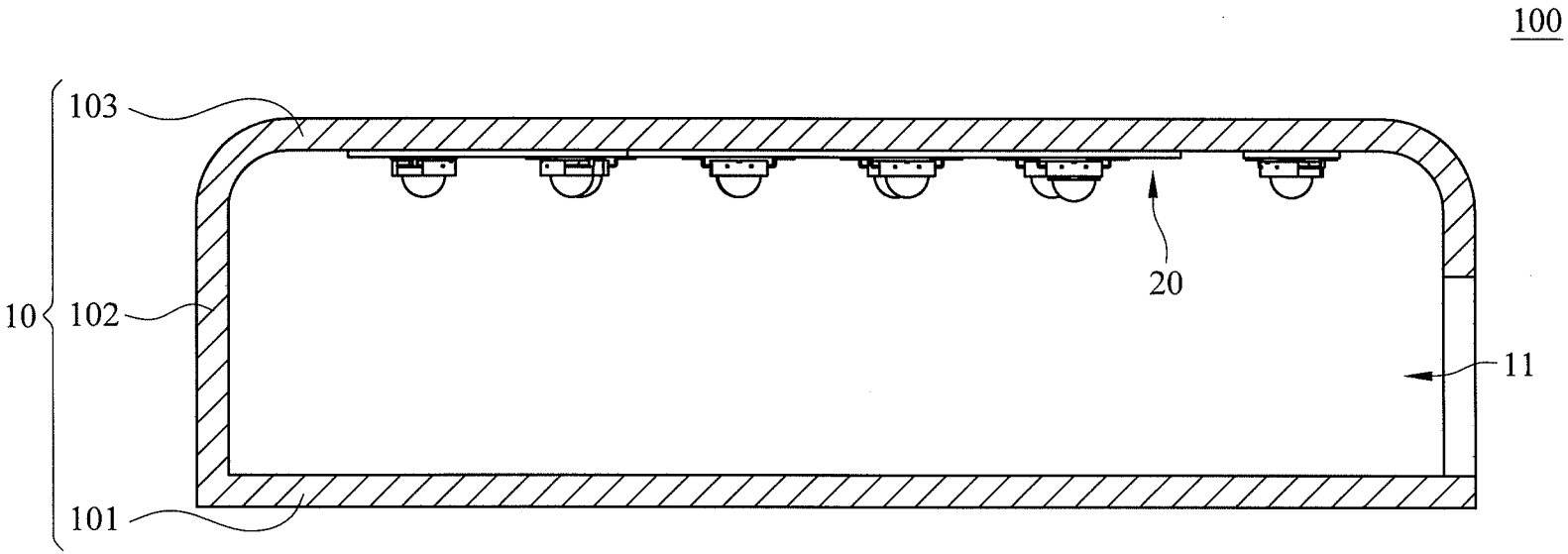
FIG. 2 is a sectional view taken along the line A-A in FIG. 1.

As shown in FIG. 2, the housing 10 includes a base plate 101, a lateral plate 102, and a top plate 103. The two ends of the lateral plate 102 are connected to the base plate 101 and the top plate 103 respectively such that the housing 10 forms a hollow structure. This hollow housing 10 has an open hollow space 11 and an opening 12. The hollow space 11 is so configured that a human hand or foot inserted through the opening 12 can be received in the hollow space 11.

The LED light source module 20 is an UV light source. To facilitate irradiation of fingernails, the LED light source module 20 is typically provided inside the housing 10 and on the upper side thereof, i.e., on the inner side of the top plate 103 of the housing 10. This allows the LED light source module 20 to project light downward.

Figure 3:
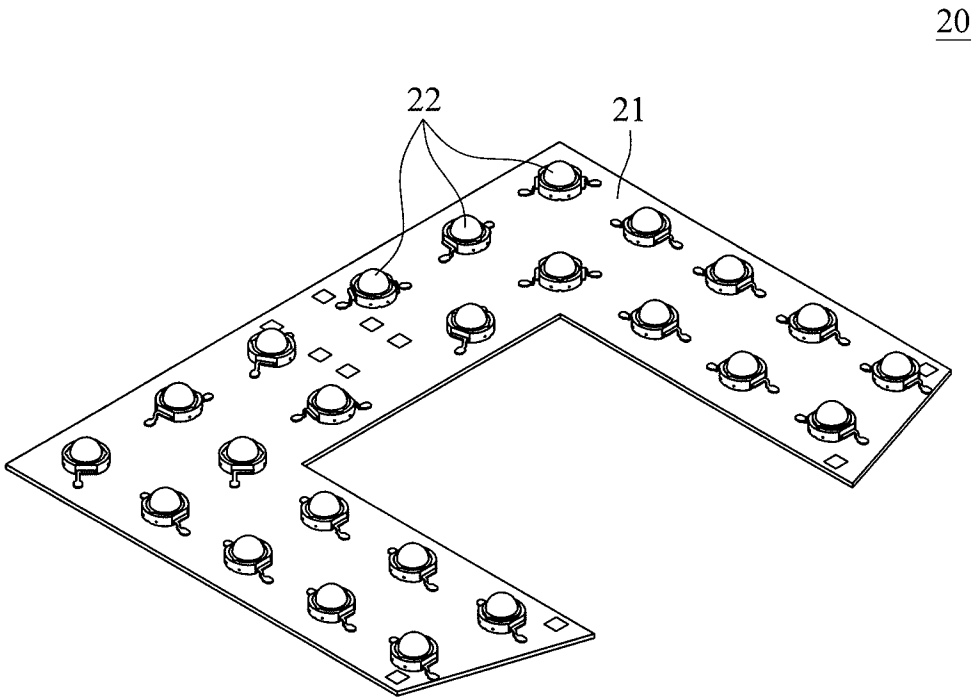
FIG. 3 is a perspective view of an LED light source module according to an embodiment of the present invention.

As shown in FIG. 3, the LED light source module 20 includes a circuit board 21 and a plurality of UV LEDs 22.

The circuit board 21 may have a modular design for easy inspection during the manufacturing process and for easy maintenance thereafter. In other words, the circuit board 21 can be composed of one or several boards. Generally, the circuit board 21 is an aluminum circuit board or a printed circuit board (PCB).

The plural UV LEDs 22 are fixed on and electrically connected to the circuit board 21. The UV LEDs 22 can be distributed over the circuit board 21 at a fixed spacing in order to provide large-area illumination.

Figure 4:
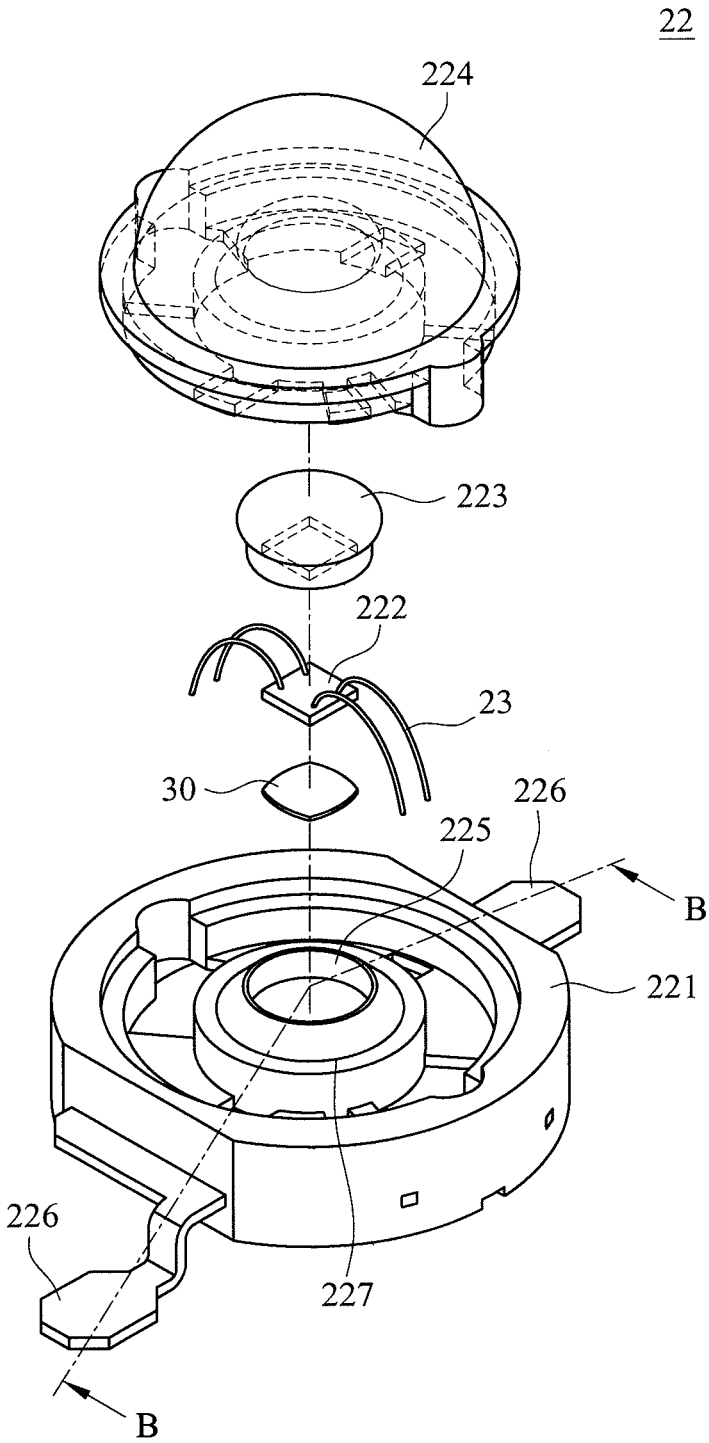
FIG. 4 is an exploded perspective view of an UV LED according to an embodiment of the present invention.
Figure 5:
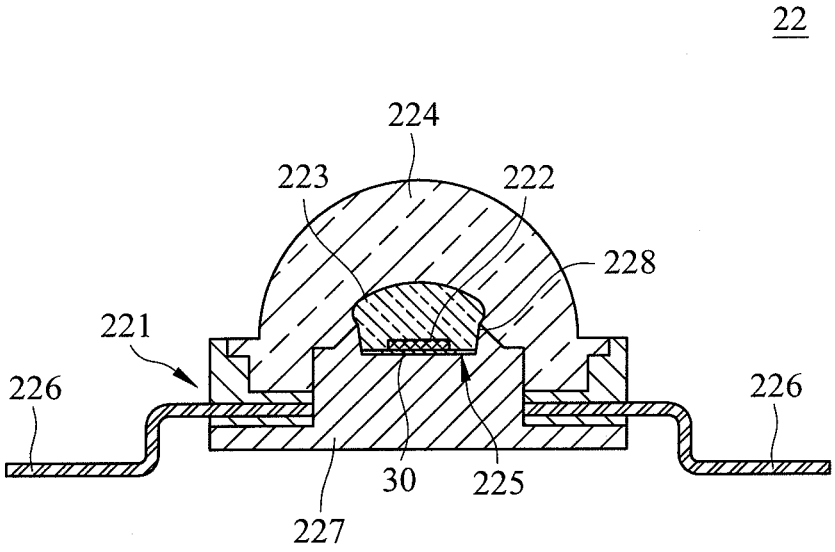
FIG. 5 is a sectional view taken the line B-B in FIG. 4.

Referring to FIGS. 4 and 5, each UV LED 22 includes a supporting frame 221, an LED chip 222, a silicone 223, and a lens 224.

The supporting frame 221 has a concave lamp cup 225 and at least two electrodes 226. In most cases, the supporting frame 221 also has a heat-conducting base 227, and the concave lamp cup 225 is a part of the heat-conducting base 227. The heat-conducting base 227 is made of a material with good heat dissipation properties, such as copper, tin, steel, iron, or like metals.

Figure 6:
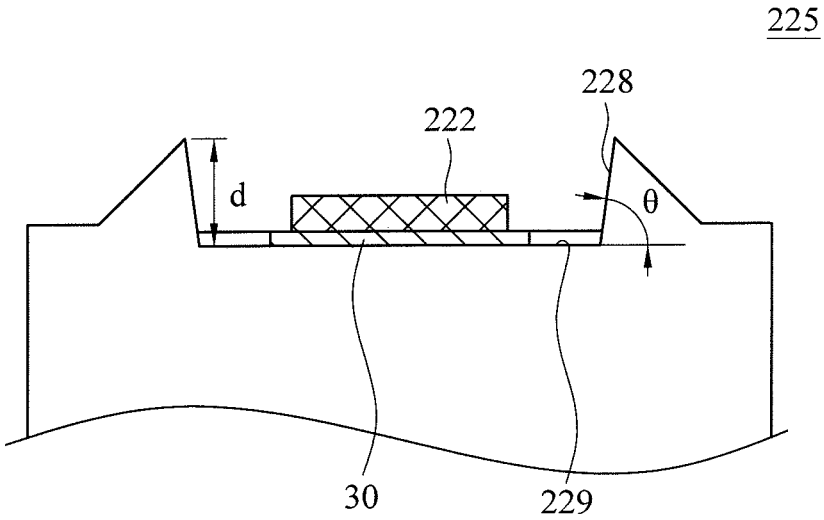
FIG. 6 is an enlarged view of the concave lamp cup shown in FIG. 5.

As shown in FIG. 6, the concave lamp cup 225 is configured for receiving the LED chip 222. In addition, the inner wall surface 228 of the concave lamp cup 225 serves to reflect the light emitted by the LED chip 222, which is located on a bottom surface 229 of the concave lamp cup 225. The light will be reflected outward of the UV LED 22 to achieve high luminance, produce the desired lighting effect, and thereby shorten the time required for curing UV curable gels. The concave lamp cup 225 has a depth d. When d is less than 1 mm or when an included angle θ between the wall surface 228 of the concave lamp cup 225 and an extension line of the bottom surface 229 is greater than 25°, the luminance of the UV LED 22 is effectively increased.

The at least two electrodes 226 are electrically connected to the LED chip 222 by wires 23, so as for the LED chip 222 to receive electric power from an external power source by way of the electrodes 226.

The LED chip 222 is disposed in and connected to the concave lamp cup 225 and is electrically connected to the electrodes 226 to obtain the electric power needed. The LED chip 222 is connected to the concave lamp cup 225 by a silver-filled epoxy 30. The silver-filled epoxy 30, which is made by mixing silver powder into epoxy, is a bonding agent capable of both electrical and thermal conduction. In addition to connecting the LED chip 222 securely to the concave lamp cup 225, the silver-filled epoxy 30 provides heat dissipation and therefore helps increase the service life and brightness of the LED chip 222.

The silicone 223 is filled in the concave lamp cup 225 and covers the LED chip 222 and the wires 23. More specifically, the silicone 223 is filled into the concave lamp cup 225 after the LED chip 222 is placed in and connected to the concave lamp cup 225, so as for the silicone 223 to cover and thereby secure both the LED chip 222 and the wires 23. As the silicone 223 is a highly transparent, highly stable, and highly water-resistant encapsulant, it can protect the LED chip 222 from moisture and dust under various environmental conditions without compromising the output of light from the LED chip 222.

The lens 224 is connected to and covers the supporting frame 221. More specifically, the lens 224 is laid over the supporting frame 221 after the silicone 223 is filled in the concave lamp cup 225. The lens 224 can be a silicone lens or a glass lens, and the light-emitting angle of the lens 224 may vary with design. When made of a silicone material, the lens 224 features a high refractive index in addition to high temperature tolerance, high insulation ability, high chemical stability, high light-permeability, and high reliability. In other words, the use of a silicone lens can avoid such drawbacks of the conventional encapsulants as material deterioration due to high temperature and the resultant attenuation of LED brightness.

The LED nail lamp structure 100 is used in the following manner. Fingers or toes whose nails are coated with an UV curable gel are inserted into the hollow space 11 of the housing 10 through the opening 12. Then, the LED light source module 20 is turned on, allowing the LED light source module 20 to emit UV light and begin a curing process on the UV curable gel. As the UV curable gel is typically a photosensitizer-containing resin and, upon absorption of UV light, generates active free radicals or ions that trigger polymerization, cross-linking, and grafting reactions, UV light can turn the UV curable gel from the liquid state to the solid state within a few seconds so that the UV curable gel coating is fixed to the nails. Since the LED nail lamp structure 100 in this embodiment provides high-luminance UV lighting, the time required for curing the UV curable gel will be shortened, and the associated costs will be reduced.

The features of the present invention are disclosed above by the preferred embodiment to allow persons skilled in the art to gain insight into the contents of the present invention and implement the present invention accordingly. The preferred embodiment of the present invention should not be interpreted as restrictive of the scope of the present invention. Hence, all equivalent modifications or amendments made to the aforesaid embodiment should fall within the scope of the appended claims.

What is claimed is:

1. A high-luminance ultraviolet (UV) light-emitting diode (LED) nail lamp structure, comprising:

a housing including a base plate, a lateral plate and a top plate, wherein two ends of the lateral plate are connected to the base plate and the top plate respectively to form a hollow housing and having an opening for a human hand or a human foot to insert into the hollow housing; and an LED light source module configured as an UV light source and provided on an inner surface of the top plate so as to project light downward, the LED light source module comprising:

a circuit board; and a plurality of UV LEDs fixedly provided on and electrically connected to the circuit board, each said UV LED comprising:

a supporting frame comprising a concave lamp cup and at least two electrodes;

an LED chip provided in and connected to the concave lamp cup and electrically connected to the electrodes;

a silicone filled in the concave lamp cup and covering the LED chip; and a lens connected to and covering the supporting frame.

2. The LED nail lamp structure of claim 1, wherein the circuit board is an aluminum circuit board or a printed circuit board (PCB).

3. The LED nail lamp structure of claim 1, wherein each said concave lamp cup has a depth less than 1 mm.

4. The LED nail lamp structure of claim 1, wherein each said concave lamp cup has a wall surface and a bottom surface, the wall surface and an extension line of the bottom surface forming an included angle greater than 25°.

5. The LED nail lamp structure of claim 1, wherein in each said UV LED, the supporting frame comprises a heat-conducting base, and the concave lamp cup is a part of the heat-conducting base.

6. The LED nail lamp structure of claim 5, wherein in each said UV LED, the LED chip is connected to the concave lamp cup by a silver-filled epoxy.

7. The LED nail lamp structure of claim 1, wherein each said lens is a silicone lens or a glass lens.

* * * * *

UNITED STATES PATENT AND TRADEMARK OFFICE

CERTIFICATE OF CORRECTION

PATENT NO. : 8,696,161 B2
APPLICATION NO. : 13/314352
DATED : April 15, 2014
INVENTOR(S) : Pan et al.

It is certified that error appears in the above-identified patent and that said Letters Patent is hereby corrected as shown below:

Title page, Column 1, under Item (73) Assignees:

Delete
"Seoul National University Industry Foundation, Seoul, Republic of Korea"

Add
--Helio Optoelectronics Corporation, ZhudongTown, Hsinchu County, Taiwan, R.O.C.--

Signed and Sealed this
Twentieth Day of May, 2014

Michelle K. Lee

Michelle K. Lee
*Deputy Director of the United States Patent and Trademark Office*